US006571783B1

(12) United States Patent
Denz et al.

(10) Patent No.: US 6,571,783 B1
(45) Date of Patent: Jun. 3, 2003

(54) IGNITION CONTROL DEVICE AND METHOD

(75) Inventors: Helmut Denz, Stuttgart (DE); Martin Haussmann, Sachsenheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/913,798

(22) PCT Filed: Nov. 10, 1999

(86) PCT No.: PCT/DE99/03568

§ 371 (c)(1),
(2), (4) Date: Dec. 10, 2001

(87) PCT Pub. No.: WO00/49289

PCT Pub. Date: Aug. 24, 2000

(30) Foreign Application Priority Data

Feb. 16, 1999 (DE) ..... 199 06 391

(51) Int. Cl.[7] ..... F02P 9/00
(52) U.S. Cl. ..... 123/609; 123/679
(58) Field of Search ..... 123/609, 679, 123/406.59, 406.55

(56) References Cited

U.S. PATENT DOCUMENTS

| | | | | |
|---|---|---|---|---|
| 4,121,556 A | | 10/1978 | Bigliani et al. | |
| 4,305,370 A | * | 12/1981 | Hohne | 123/406.59 |
| 4,432,325 A | | 2/1984 | Auracher et al. | |
| 4,649,888 A | | 3/1987 | Kawai et al. | |
| 4,702,211 A | * | 10/1987 | Kato et al. | 123/406.55 |
| 5,007,397 A | | 4/1991 | Akasu | |
| 5,271,367 A | | 12/1993 | Abe | |
| 5,419,295 A | * | 5/1995 | Andersson | 123/406.57 |
| 5,823,167 A | * | 10/1998 | Fukuchi et al. | 123/406.55 |
| 5,957,110 A | * | 9/1999 | Yoshioka | 123/406.49 |
| 6,135,087 A | * | 10/2000 | DeGeorge et al. | 123/406.52 |
| 6,237,566 B1 | * | 5/2001 | Spaulding | 123/406.13 |

FOREIGN PATENT DOCUMENTS

| | | |
|---|---|---|
| EP | 0 846 859 | 6/1998 |
| JP | 54 158 531 | 12/1979 |

* cited by examiner

*Primary Examiner*—John Kwon
(74) *Attorney, Agent, or Firm*—Kenyon & Kenyon

(57) ABSTRACT

The present invention relates to an ignition control device for the control of an ignition coil device for an internal combustion engine having an engine speed detection device for detecting the engine speed of the internal combustion engine at a detection instant within the ignition cycle of a given cylinder; a determination device for determining a predetermined ignition angle corresponding to the detected engine speed, a charging time corresponding to the detected engine speed and an appropriate start-of-charging angle; an ignition control value output device to output the start-of-charging angle and the charging time in a charging time output mode and to output the start-of-charging angle and the ignition angle in an ignition output mode to the ignition coil device; a detection device for detecting critical power loss states of the ignition control device driver stage in ignition angle output mode; and an ignition control mode determination device for selecting an ignition control mode from among the ignition angle mode output and charging time output mode for the ignition cycle; the ignition control mode determination device being configured in such a way that it selects charging time output mode if a critical power loss state of the ignition coil device driver stage is detected in ignition angle output mode.

14 Claims, 2 Drawing Sheets

IGNITION CONTROL DEVICE AND METHOD

FIELD OF THE INVENTION

The present invention relates to an ignition control device and a corresponding ignition control method.

Although usable on any ignition control, the present invention and the set of problems on which it is based is explained with reference to an engine control unit located on board a motor vehicle.

BACKGROUND INFORMATION

Ignition control devices for controlling ignition events for ignition coil ignition systems or devices have essentially two control functions: the control of a desired ignition energy throughout the energization period or charging time of the ignition coil and the correct angle control of an ignition pulse via the deenergization point or the end of charging time of the ignition coil.

The ignition energy that is supplied in coil ignition systems over the course of an ignition coil charging time is of varying duration corresponding to the vehicle electrical system voltage applied to the electrical circuit of the coil and the time constant of the electrical circuit.

Typically, the particular setpoint values are stored in the control unit as a function of the engine speed and other possible engine parameters as a field of characteristics.

The setpoint values of "charging time" and "ignition angle" create a conflict of goals when engine speed dynamics come into play. The angular position of the beginning of the charging phase, thus the start-of-dwell angle, must be selected such that the ignition angle is reached after the end of the charging time. That means that at the instant the ignition event is calculated, the timing-angle curve of the crankshaft movement must be known in advance.

Extreme engine speed dynamics and low engine speed sampling rate, especially during engine cranking, cause a non-negligible estimation error of this timing-angle curve in standard ignition control devices.

Standard control units are equipped with a phase-angle sensor wheel, which supplies angle-equidistant pulses to the ignition-control device, for the output of angle signals. For reasons of computing time, the calculation of the ignition events in most ignition control device architectures, however, can be achieved only in segments, a segment being the angular interval of 720° of the crankshaft divided by the number of cylinders, thus 180° for a four-cylinder engine. Therefore, although the angular positions of the ignition events determined in the calculation can be measured with sufficient accuracy by the phase-angle sensor wheel and the timer/counter circuits typical for ignition control systems, the calculation itself assumes a detected engine speed that no longer exists at the location of the ignition when there are engine speed dynamics.

To explain the problems, FIG. 2 shows a schematic diagram of the firing sequence in a four-cylinder internal combustion engine.

In FIG. 2 the crank angle KW is recorded in degrees on the x-axis and the ignition curve ZZ, which has the sequence . . . −2−1−3−4−2 . . . , is recorded on the y-axis. One complete cycle is 720° of crank angle KW, corresponding to one cycle time of $t_{ZYK}$. One segment is 720° KW/4= 180°, corresponding to one segment time of $t_{SEG}$.

FIG. 3 shows a schematic diagram of the ignition control functional sequences in the segment of the first cylinder of a four-cylinder internal combustion engine with respect to the triggering of the ignition coil current $I_Z$.

At 0°, the engine speed N is detected and immediately thereafter the charging time $t_L$ , and the ignition angle $w_Z$ (approximately equal to the end-of-dwell angle) are derived from a field of characteristics B.

Next, the start-of-dwell or start-of-charging angle $w_{LB}$ from the relation $$W_{LB}=W_Z-t_L\cdot\omega$$

is determined assuming a uniform movement, ω being the angular speed corresponding to the engine speed N. For reasons of computing time, this time and angle position of the ignition event is calculated only once per firing interval.

In the case of charging time output mode, the angle $w_{LB}$ is detected via the crankshaft sensor signal KWS using a counter C1 starting from 0°, and upon reaching the angle $w_{LB}$, the ignition coil driver stage is triggered. Then the charging time $t_L$ is controlled using a timer, and after expiration of the charging time $t_L$, the drive signal is interrupted.

In the case of ignition angle output mode, the angle $w_{LB}$ is detected via the crankshaft sensor signal KWS using a counter C1 starting from 0°, and upon reaching the angle $w_{LB}$, the ignition coil driver stage is triggered. The angle $w_Z$ is detected via the crankshaft sensor signal KWS using a counter C2 starting from 0°, and upon reaching the angle $w_Z$, the drive signal is interrupted.

Since the error calculation of the engine speed curve is not negligible, e.g., in the case of engine cranking, the control targets of charging time and ignition angle are typically prioritized for ignition control devices. If the exact output of the charging time—so-called charging time output mode—via the timer/counter circuit is desired, then this causes a retarding of the ignition angle during starting acceleration (engine speed increase). If, on the other hand, the ignition angle is output exactly—so-called ignition angle output mode—then the charging time, and with it the energy in the ignition coil, is reduced in the starting dynamics. Consequently, this can cause misfires.

Typically, the output method, i.e. charging time output or ignition angle output, is therefore permanently set as a function of the characteristics of the target system, or else the output method is switched at a limit engine speed. Typical in this context is a charging time output during cranking and a switch to ignition angle output beginning at a limit engine speed at which the engine speed sampling is frequent enough that the dynamics error becomes negligible, and at which, on the other hand, the sensitivity of the torque also increases sharply via the ignition angle.

In charging time mode, as explained above in reference to FIG. 3, the charging time cycle runs through after reaching the start-of-charging angle and ignition is triggered in the coil when the setpoint energy is met exactly. In this way sufficient energy is guaranteed at a minimal power loss. At low engine speed and high acceleration, the ignition angle is retarded as a function of the dwell period and the position of the setpoint ignition angle. Therefore, in the application of the ignition angle, a dynamic phase lead is appropriately added in the advancing direction when the engine speed is on the order of magnitude of the starter speed.

In ignition angle output mode, as explained above with reference to FIG. 3, the ignition angle is sized independent of the start-of-charging angle. When an acceleration starts, ignition occurs before expiration of the charging time. In the application under these circumstances a dynamic phase lead is appropriately applied in the retarding direction precisely when there is high acceleration and low engine speed.

Larger dynamic phase leads than absolutely necessary are applied as a rule , and this results in power loss also in the ignition components in charging time output mode and the danger of reverse rotations in ignition angle output mode. The greatest deviation from the setpoint value always occurs during the second ignition firing. In this case the engine speed is still low and the acceleration is typically already very high.

The selection of the output mode is typically also a function of how large the errors, and thus the necessary phase leads on the energy or the ignition angle side, can become. However, with new ignition applications, the case can now arise, wherein when the engine is cold and the fuel mixture is lean, the ignition angle sensitivity increases; i.e., ignition angle output mode should be selected. However, since ignition driver stages of the newer generation are mounted directly on the cylinder head, the dissipation of power loss becomes problematic primarily when the engine is hot. This would nevertheless speak in favor of charging time output mode.

SUMMARY OF THE INVENTION

The ignition control device of the present invention and the corresponding ignition control method have the advantage over the known approaches that an ignition method suitable for the current physical circumstances of the ignition control device is selected.

This is pertinent with ignition control devices that do not permit a clear-cut prioritization of the output methods of charging time output and ignition angle output. In this case the use of ignition units, i.e., coil and ignition devices, that have moderate charging times and are mounted on the cylinder head, which under some circumstances is hot, brings with it additional degrees of freedom. Furthermore, the invention makes the application of the ignition control device easier, since the mode selection is automatically determined from the current physical circumstances. Adaptation to the requirements of different areas of use is, as a result, substantially easier.

The idea on which the present invention is based is that charging time output mode is always activated in critical power loss states when there is poor knowledge of the timing-angle curve. Such critical power loss states are automatically known in this context from a simple computational model for estimating the temperature in the driver stage. If charging time output is chosen based on a critical power loss state, this choice overrides other possible changeover criteria particularly for the protection of components.

According to one preferred refinement, a phase lead determination device is provided for setting a dynamic phase lead in the retarding direction at given engine speeds when there is positive acceleration for ignition angle output mode, preferably at low speeds, and/or for setting a dynamic phase lead in the advancing direction for charging time output mode.

According to another preferred refinement, the detection device for the detection of critical power loss states of the ignition coil device driver stage in ignition angle output mode has a temperature determination device for determining the temperature of the ignition coil device driver stage; a temperature increase forecasting device to forecast a temperature increase of the ignition coil device driver stage after an ignition event in ignition angle output mode; and a decision device for deciding on a critical power loss state, if the determined temperature increase exceeds a predetermined value and preferably if at the same time the detected engine speed falls below a predetermined value.

According to another preferred refinement, the temperature determination device for determining the temperature of the ignition coil device driver stage has a temperature detection device for detecting the engine temperature and a temperature estimation device for estimating the temperature of the ignition coil device driver stage based on the detected engine temperature.

DETAILED DESCRIPTION

In the figures the same reference numbers designate equal or functionally equivalent elements.

Figure 1:
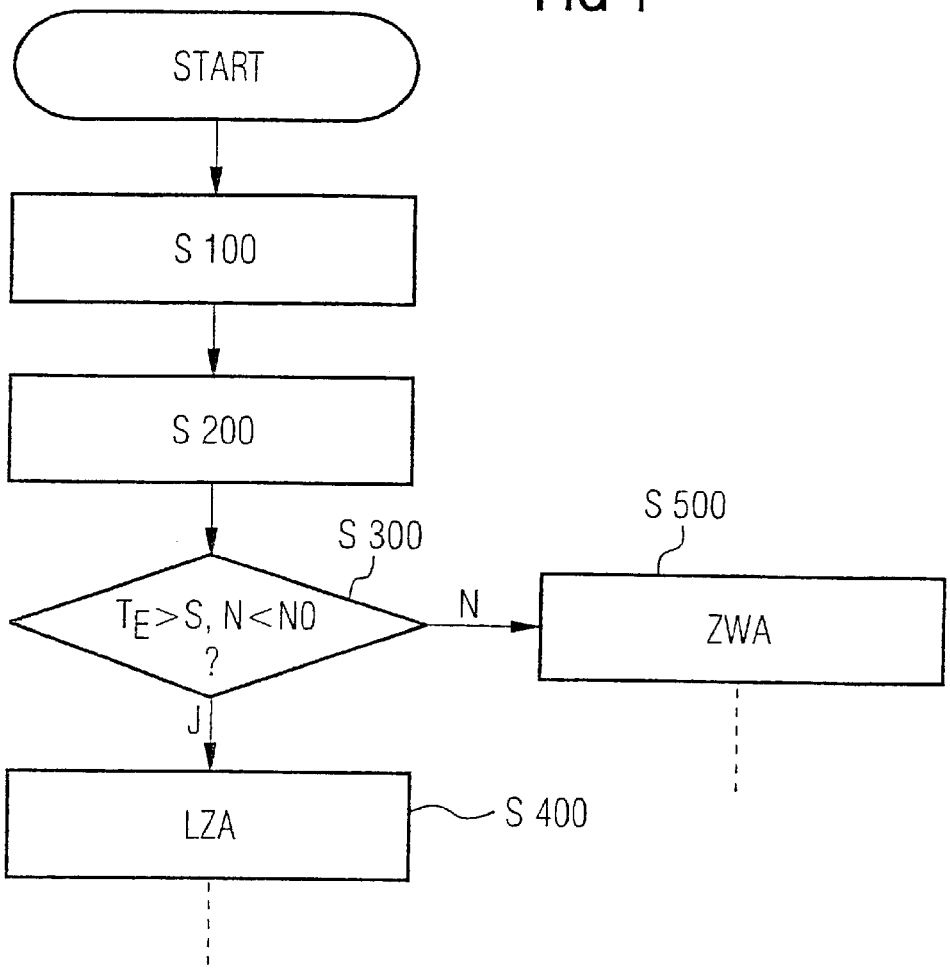
FIG. 1 shows a flow chart to explain one exemplary embodiment of the present invention.
Figure 2:
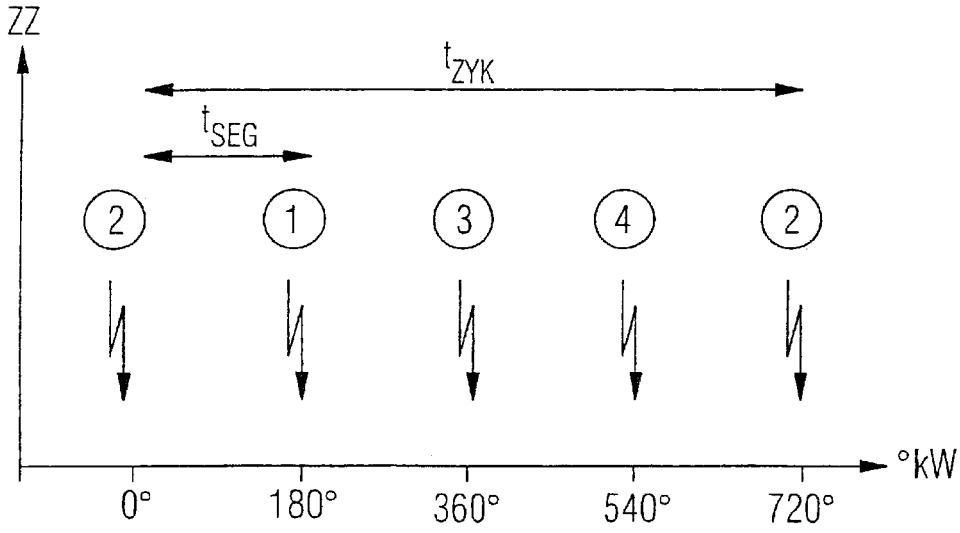
FIG. 2 shows a schematic diagram of the firing sequence for a four-cylinder internal combustion engine.
Figure 3:
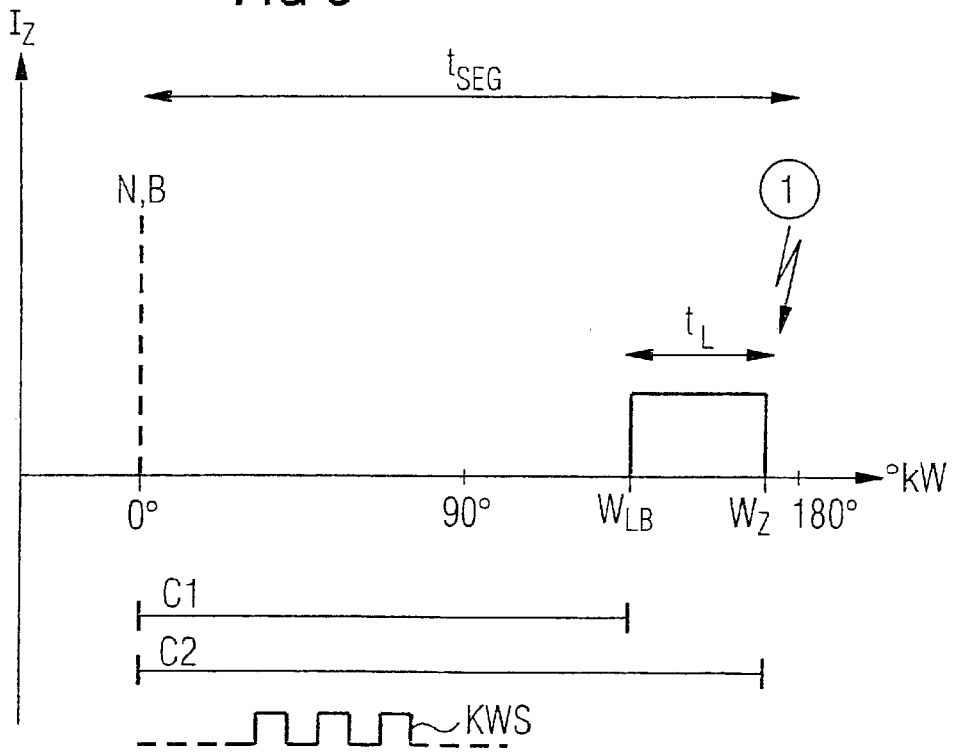
FIG. 3 is a schematic diagram of the ignition control function sequence in the segment of the first cylinder of the four-cylinder internal combustion engine.

FIG. 1 shows a flow chart to explain one exemplary embodiment of the present invention. In this exemplary embodiment, the following procedure is proposed.

In ignition angle output mode, a large dynamic phase lead is applied to the charging time in the retarding direction at low engine speed. This can cause the ignition coil driver stage to overheat when starting the engine while it is hot, especially in the static case, or in the case of a negative change of the engine speed.

If the coil temperature is very high, e.g., when starting the engine while it is hot, then the power loss is to be minimized; i.e., a switch to charging time output mode is made, since no dynamic phase lead in the retarding direction that produces additional power loss is added to the charging time in this mode.

The temperature level of the driver stage housing is derived from the engine temperature, which is measured in step S100. The engine temperature $t_{mot}$ plus an offset is used as the ignition coil driver stage housing temperature.

To track the temperature of the ignition coil driver stage, which is estimated in step S200, a simple temperature model is assumed.

The power loss of the driver stage is represented as a function of the projected charging time including dynamic phase lead. The power loss produces a temperature increase via the thermal resistances up to the mounting location of the driver stage housing. The thermal resistance in this case is represented as a proportionality constant.

The transition from the base temperature of the driver stage (housing temperature) to the level of the temperature increase is represented by a first-order low-pass. If the temperature curve $T_E$ of the driver stage exceeds a threshold and the engine speed N is below a threshold N0, then a switch is immediately made to charging time output mode. This criterion overrides all other criteria for switching modes for practical purposes.

In proceeding further, charging time output mode ZWA can be maintained or, if, on the other hand, the limit value S is undershot or the threshold N0 for the engine speed is exceeded, a switch can be made back to ignition angle output mode LZA. Other criteria can also be incorporated for the subsequent mode decisions, e.g. error estimations, etc.

If the ignition outputs a group of ignition pulses instead of one ignition pulse, then the cumulative charging time is used as the charging time. The power loss is also assessed using a factor for the spark group. The power loss is obtained as a function of the cumulative charging time for one ignition firing in relation to the duration of one operating cycle.

A concrete example for a temperature model is indicated below for which it is assumed that the driver stage is located on a temperature sink whose temperature is directly correlated to the engine temperature tmot. The upper value of the temperature increase in the driver stage is obtained from the power loss and the thermal resistances up to the heat sink. The housing temperature tambient is obtained as follows:

$$t\text{ambient}=t\text{mot}-d\text{temp}$$

with dtemp being the temperature difference between housing temperature and engine temperature.

This yields the power loss $p_{loss}$ as a function of the dwell time via the equation below.

$$P\text{loss}=f(\text{dwell time})+fubaanz\cdot\text{correction factor},$$

with dwell time being the cumulative dwell period, i.e., for conventional ignition systems, the charging time and for ignition via a spark group, the sum of all dwell times, fubaanz being the number of sparks emitted by the ignition control device with an active spark group ignition system and correction factor being a correction factor of the power loss equilibrium since the power loss equilibrium is calculated differently for the utilization of residual energy in a spark group ignition system.

The final temperature increase in the driver stage is obtained by the following formula:

$$d\text{tloss}=P\text{loss}\times\text{Factorthermal conduction}$$

with dtloss being the temperature increase caused by power loss and Factorthermal conduction being a proportionality constant corresponding to the thermal conduction.

The temperature curve is obtained via a first-order low-pass as:

$$t\text{driver stage}=t\text{ambient}+(1-e^{-t/\tau})d\text{tloss}$$

with tdriver stage being the estimated temperature of the driver stage, t being the time and –Tau– being a time constant.

As soon as tdriver stage is larger than the aforementioned threshold S, provided the engine speed N is still lower than a threshold N0 at which point the ignition output still has only negligible tolerances, the switch to charging time output is made.

Although the present invention was described above with respect to preferred exemplary embodiments, it is not limited to them, but rather can be modified in a variety of ways.

Although the example given above indicates only the temperature criterion relevant for the present invention, other criteria for mode switching can obviously be incorporated.

What is claimed is:

1. An ignition control device for controlling an ignition coil device for an internal combustion engine having at least one cylinder and at least one driver stage, comprising:

an engine speed detection device for detecting an engine speed of the internal combustion engine;

an angle detection device for detecting an instantaneous crankshaft angle of the internal combustion engine;

a first determination device for determining an ignition angle, a charging time, and a start-of-charging angle corresponding to the detected engine speed;

a second determination device for determining an instantaneous temperature of the at least one driver stage;

a calculation device for calculating a future temperature of the at least one driver stage; and an output device that is one of operable in a charging time output mode if one of the instantaneous temperature and the future temperature of the at least one driver stage exceeds a temperature threshold and operable in an ignition angle output mode if one of the instantaneous temperature and the future temperature of the at least one driver stage does not exceed the temperature threshold, wherein:

the output device operating in the charging time output mode outputs the start-of-charging angle and the charging time, the output device operating in the ignition angle output mode outputs the start-of-charging angle and the ignition angle, a time elapsed from a given reference is determined by a comparison to a timer, and an angle from a given reference point is determined by a comparison to a signal of the angle detection device.

2. The ignition control device according to claim 1, further comprising:

a comparison device for comparing the detected engine speed to an engine speed threshold, wherein:

an operation is possible in the charging time output mode with the aid of the output device if the detected engine speed is below the engine speed threshold, the operation is possible in the ignition angle output mode if the detected engine speed is above the engine speed threshold.

3. The ignition control device according to claim 1, further comprising:

a dynamic phase lead setting device for at least one of:

when a positive acceleration is present, setting a dynamic phase lead in a retarding direction for the ignition angle output mode at given engine speeds, and setting the dynamic phase lead in an advancing direction for the charging time output mode.

4. The ignition control device according to claim 3, wherein:

the given speeds correspond to low engine speeds.

5. The ignition control device according to claim 1, wherein:

via the first determination device, the charging time is determined as a function of a battery voltage.

6. The ignition control device according to claim 1, wherein:

the second determination device includes:

an arrangement for determining an engine temperature, and an arrangement for calculating the instantaneous temperature of the at least one driver stage from the determined engine temperature.

7. The ignition control device according to claim 1, wherein:

a power loss resulting during the charging time is taken into consideration via the calculation device for calculating the future temperature of the at least one driver stage, and a sum of resulting power losses of all charging times is taken into consideration in the case of a spark group ignition system.

8. A method for a control of an ignition coil device for an internal combustion engine having at least one cylinder and at least one driver stage, comprising the steps of:

detecting a speed of the internal combustion engine;

detection an instantaneous crankshaft angle of the internal combustion engine;

determining an ignition angle, a charging time, and a start-of-charging angle corresponding to the detected engine speed;

detecting an instantaneous temperature of the at least one driver stage and calculating a future temperature of the at least one driver stage; and performing one of the following:

operating an output device in a charging time output mode if one of the instantaneous temperature and the future temperature of the at least one driver stage exceeds a temperature threshold, and operating the output device in an ignition angle output mode if one of the instantaneous temperature and the future temperature of the at least one driver stage does not exceed the temperature threshold, wherein:

the start-of-charging angle and the charging time are output in the charging time output mode, the start-of-charging angle and the ignition angle are output in the ignition angle output mode, a time elapsed from a given reference point is determined by a comparison with a timer, and an angle reached from the given reference point is determined by a comparison with a signal corresponding to the instantaneous crankshaft angle.

9. The ignition control method according to claim 8, further comprising the steps of:

comparing the detected engine speed with an engine speed threshold value;

operating the output device in the charging time output mode if the detected engine speed is below the engine speed threshold value; and operating the output device in the ignition angle output mode if the detected engine speed is above the engine speed threshold value.

10. The ignition control method according to claim 8, further comprising performing at least one of the following steps:

when a positive acceleration is present, setting a dynamic phase lead in a retarding direction for the ignition angle output mode at given engine speeds; and setting the dynamic phase lead in an advancing direction for the charging time output mode.

11. The ignition control method according to claim 10, wherein:

the given speeds correspond to low engine speeds.

12. The ignition control method according to claim 8, further comprising the step of:

determining the charging time as a function of a battery voltage.

13. The ignition control method according to claim 8, further comprising the steps of:

determining an engine temperature; and calculating the instantaneous temperature of the at least one driver stage from the determined engine temperature.

14. The ignition control method according to claim 8, wherein:

a power loss resulting during the charging time is taken into consideration for calculating the future temperature of the at least one driver stage, and a sum of resulting power losses of all charging times is taken into consideration in the case of a spark group ignition system.

* * * * *